US005312235A

United States Patent [19]

McHugh

[11] Patent Number: 5,312,235

[45] Date of Patent: May 17, 1994

[54] APPARATUS FOR REDUCING PRESSURE PULSATIONS

[75] Inventor: Paul McHugh, Redfern, Australia

[73] Assignee: Northern Research & Engineering Corporation, Woburn, Mass.

[21] Appl. No.: 126,480

[22] Filed: Sep. 24, 1993

[51] Int. Cl.[5] ..... F01C 13/00

[52] U.S. Cl. ..... 418/181; 410/201.1

[58] Field of Search ..... 418/181, 201.1; 417/540; 138/26

[56] References Cited

U.S. PATENT DOCUMENTS 2,474,512 6/1949 Bechtold et al. ..... 417/540
2,910,830 11/1959 White .
4,411,592 10/1983 Traver et al. ..... 415/119
4,504,188 3/1985 Traver et al. ..... 415/1
4,923,374 5/1990 Lundin et al. ..... 418/201.1

*Primary Examiner*—Richard A. Bertsch
*Assistant Examiner*—Charles G. Freay
*Attorney, Agent, or Firm*—Michael H. Minns

[57] ABSTRACT

An apparatus for reducing the pressure pulse amplitudes in the discharge piping of a screw compressor. A stub pipe is added to the compressor discharge piping. By tuning the stub pipe dimensions, the reflected pulse from the stub pipe is combined with the reflected pulse from the discharge piping so that the pulse arriving back at the discharge of the compressor is out of phase with the compressor discharge pulse, reducing the pulse amplitude in the pipe.

3 Claims, 5 Drawing Sheets

APPARATUS FOR REDUCING PRESSURE PULSATIONS

BACKGROUND OF THE INVENTION

This invention relates generally to air compressor systems and more particularly to screw compressor systems.

The discharge air of a screw compressor contains pressure pulses produced by the discharge porting. If the discharge pipe dimensions are not compatible with the discharge porting frequency, the pulses may be amplified by the discharge pipe. The acoustic reflection of the pulses in the discharge pipe arrive back at the discharge port in phase with the porting pulses. This can result in large pressure pulses in the discharge pipe which can cause pipe vibrations and eventual cracking of the pipe.

Due to packaging or designs constraints, it may not be possible to re-dimension the discharge pipe to avoid the pulse amplification.

The foregoing illustrates limitations known to exist in present screw compressor systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing in combination: a screw compressor; a tank; a conduit connecting the discharge of the screw compressor to the inlet of the tank; and a compensation means for reducing the pulse amplitude of pressure pulses in the conduit, the compensation means comprising a chamber attached to the conduit, the discharge of the screw compressor containing primary pressure pulsations, the primary pressure pulsations being reflected back to the discharge of the screw compressor as reflected pressure pulsations, the primary pressure pulsations also being reflected back from the chamber to the discharge of the screw compressor as compensating pressure pulsations, the compensating pressure pulsations combining with the reflected pressure pulsations so that the combined pressure pulsations arrive at the discharge of the screw compressor out of phase with the primary pressure pulsations thereby reducing the pulse amplitude of the pressure pulses.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
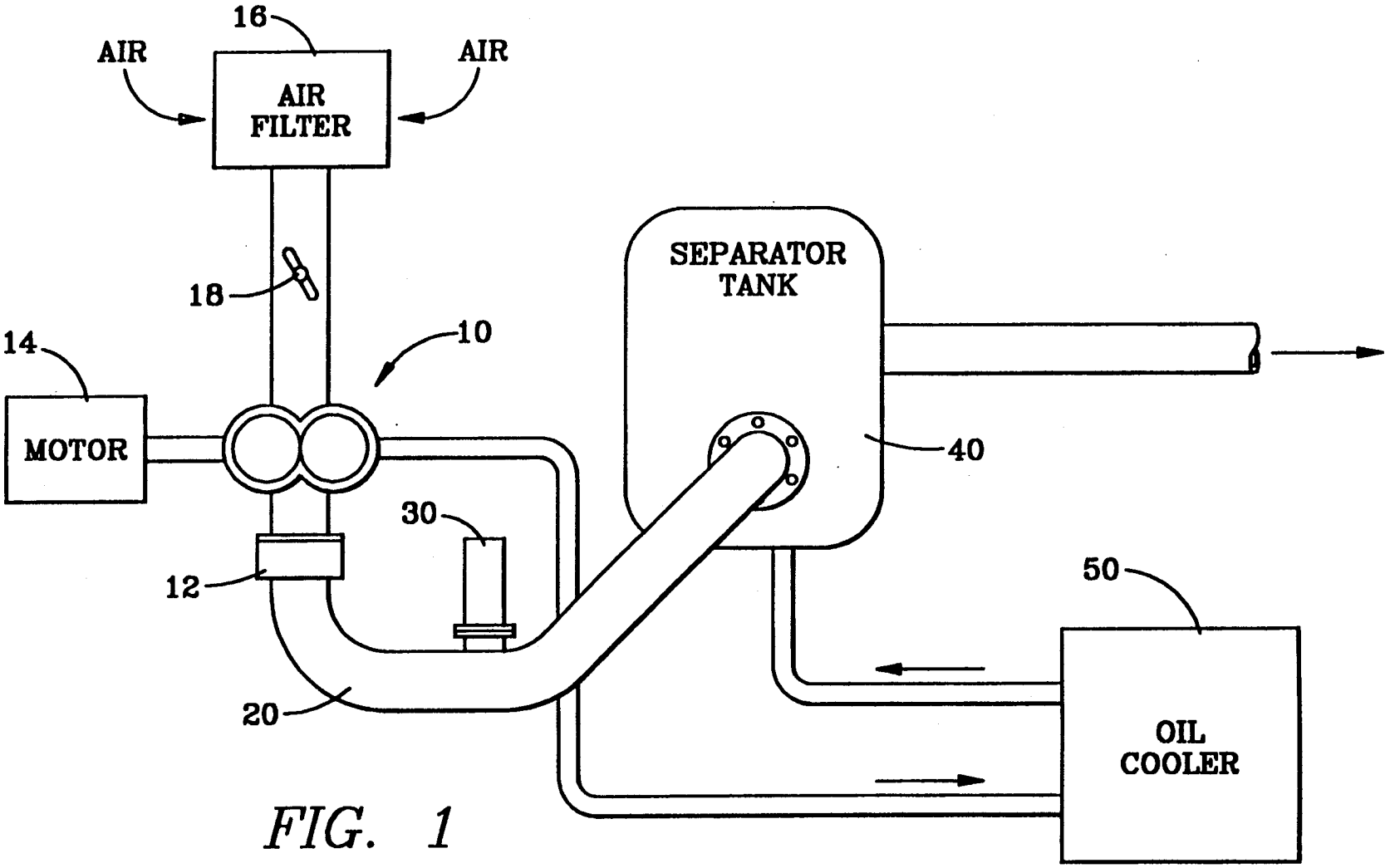
FIG. 1 is a schematic representation of a screw compressor system.

A typical system for a screw compressor is shown in FIG. 1. Frequently these systems are manufactured as a complete skid mounted unit. This significantly limits the spacing and arrangements of the components.

Shown is a screw compressor 10 driven by an electric motor 14. Inlet air is provided to the screw compressor 10 through an air filter 16 and inlet throttle valve 18. A check valve 12 is provided downstream of the screw compressor 10 discharge. Discharge piping 20 connects the screw compressor 10 discharge to a separator tank 40. In a screw compressor, a lubricating fluid, such as oil, is provided as a lubricant for the screws of the compressor. As a result, oil is entrained in the discharge air. Normally, it is necessary to separate (in the separator tank 40) the oil from the pressurized air. The removed oil is cooled in an oil cooler 50 and returned to the screw compressor 10.

Because of the diameter, length and configuration of the discharge piping 20, primary pressure pulsations from the discharge of the screw compressor 10 can be reflected back towards the screw compressor 10 as reflected pressure pulsations. If the reflected pressure pulsations are in phase with the primary pressure pulsations, an unacceptable increase in the pulse amplitude may occur.

The present invention is a means of reducing the pulse amplitude of these pressure pulsations. A chamber or stub pipe 30 is connected to the discharge piping 20 between the screw compressor 10 and the separator tank 40. The primary pressure pulsations are also reflected in the stub pipe 30 as compensating pressure pulsations. The compensating pressure pulsations are combined with the reflected pressure pulsations so that the combined pressure pulsations arrive at the discharge of the screw compressor 10 out of phase with the primary pressure pulsations, thereby reducing the pulse amplitude of the pressure pulses.

Figure 2:
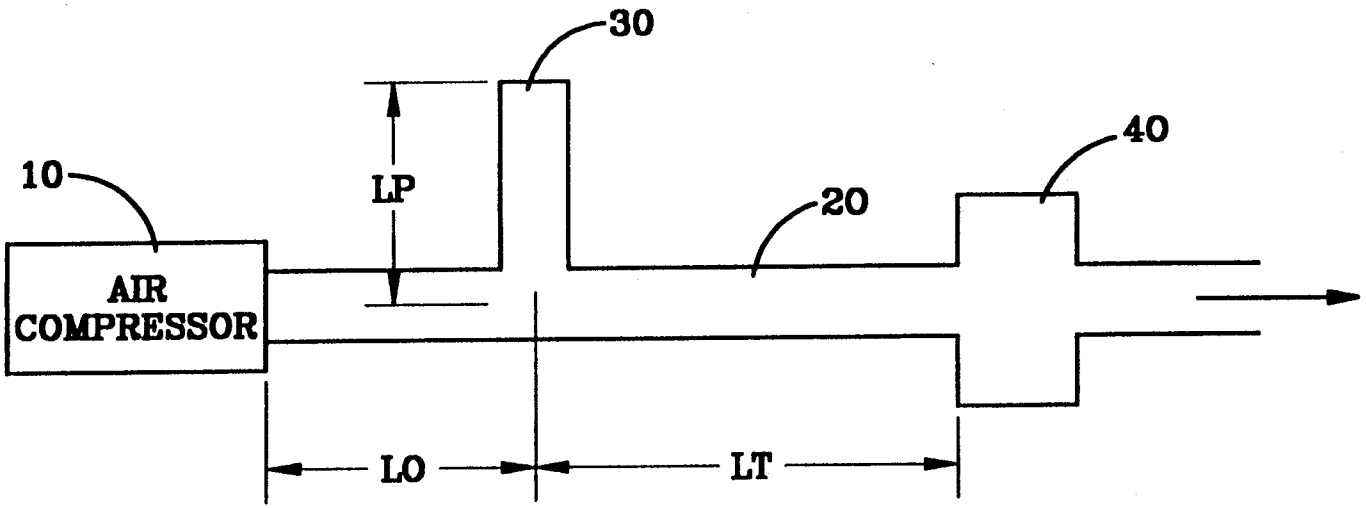
FIG. 2 is a schematic representation of the screw compressor discharge piping and stub pipe location.
Figure 3:
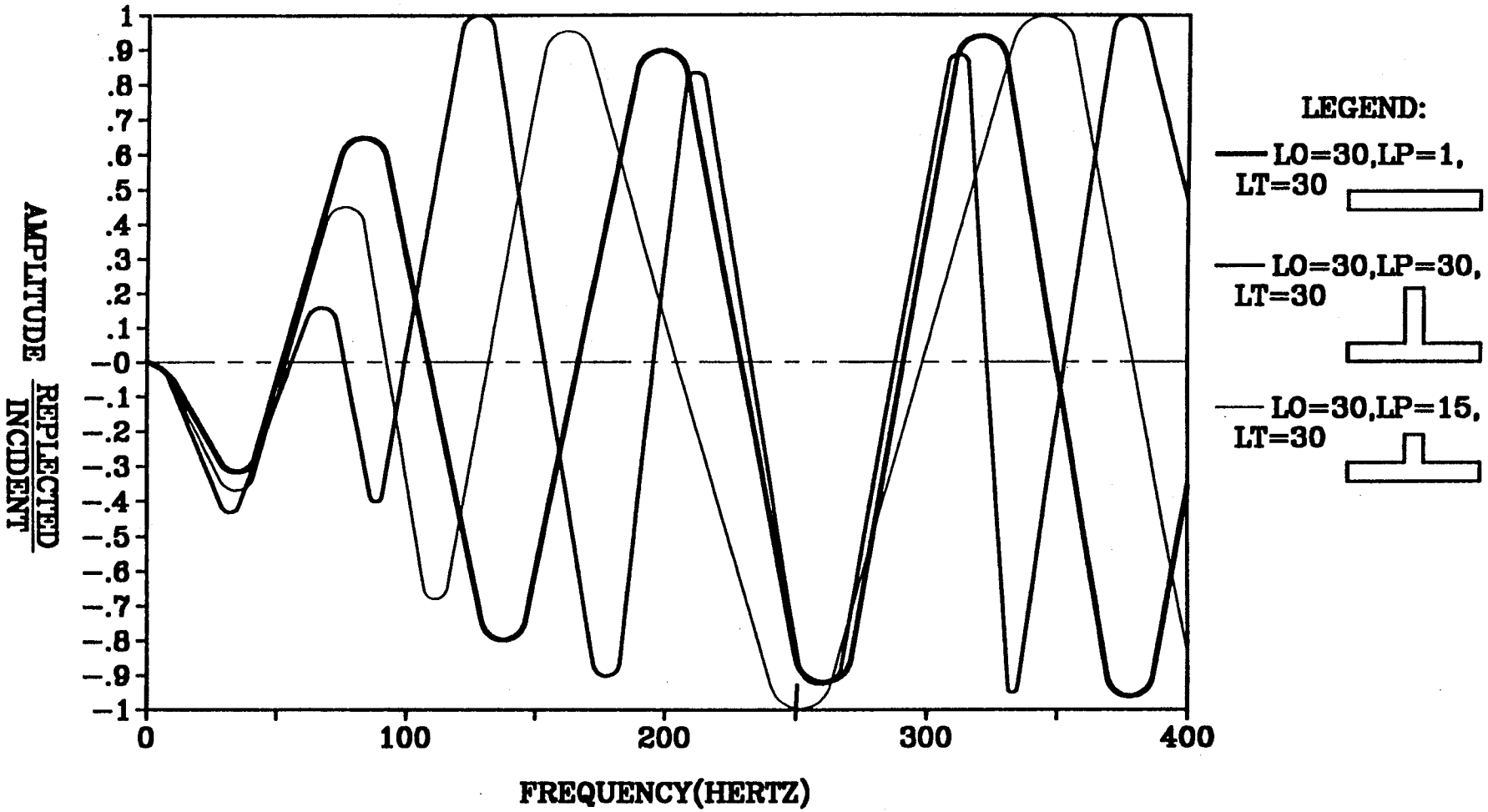
FIG. 3 is a plot of the predicted ratio of the reflected wave amplitude to the incident wave amplitude for different stub pipe lengths.
Figure 4:
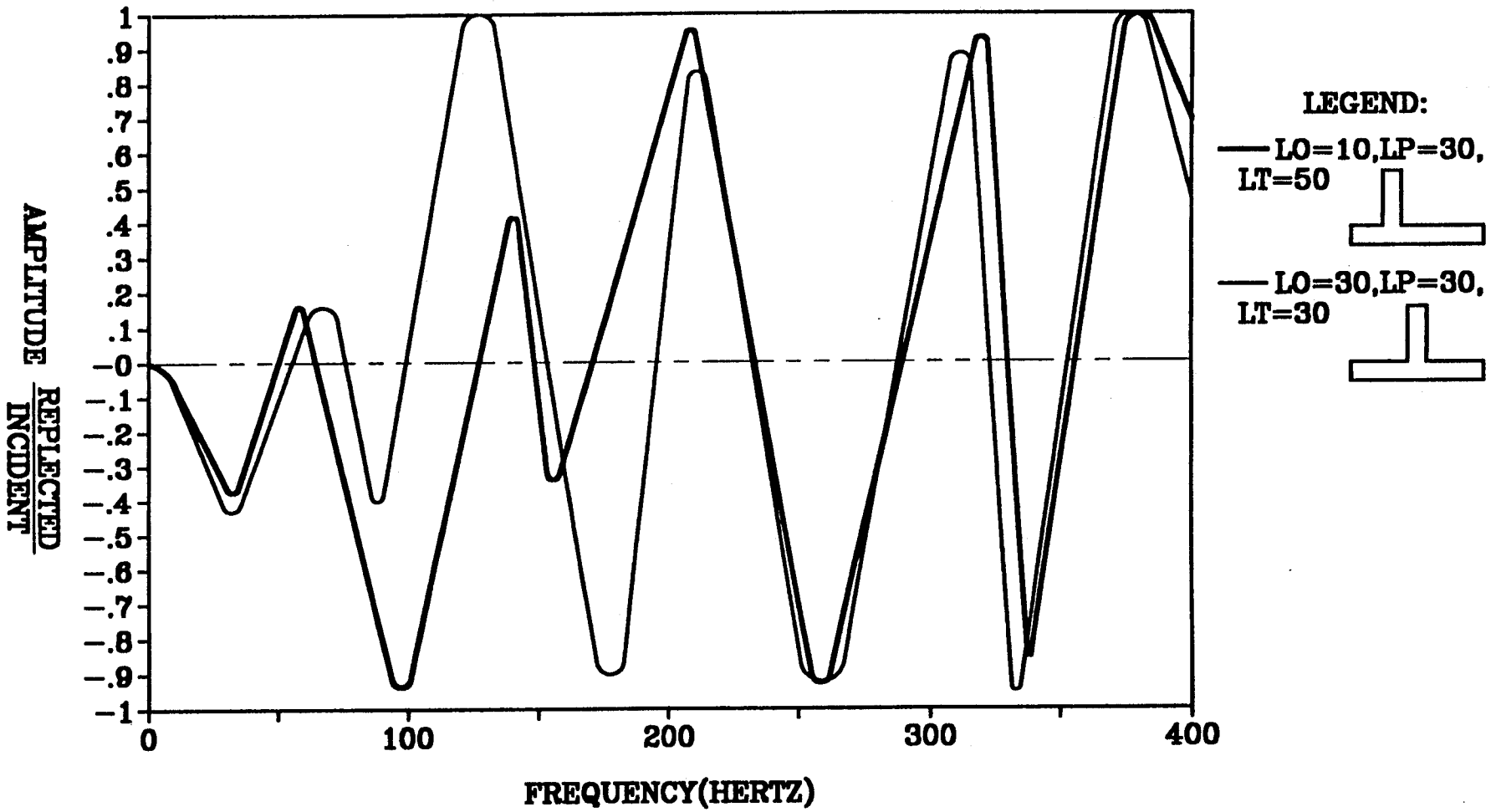
FIGS. 4 and 5 are plots of the predicted ratio of the reflected wave amplitude to the incident wave amplitude for different stub pipe locations and two different stub pipe lengths.
Figure 5:
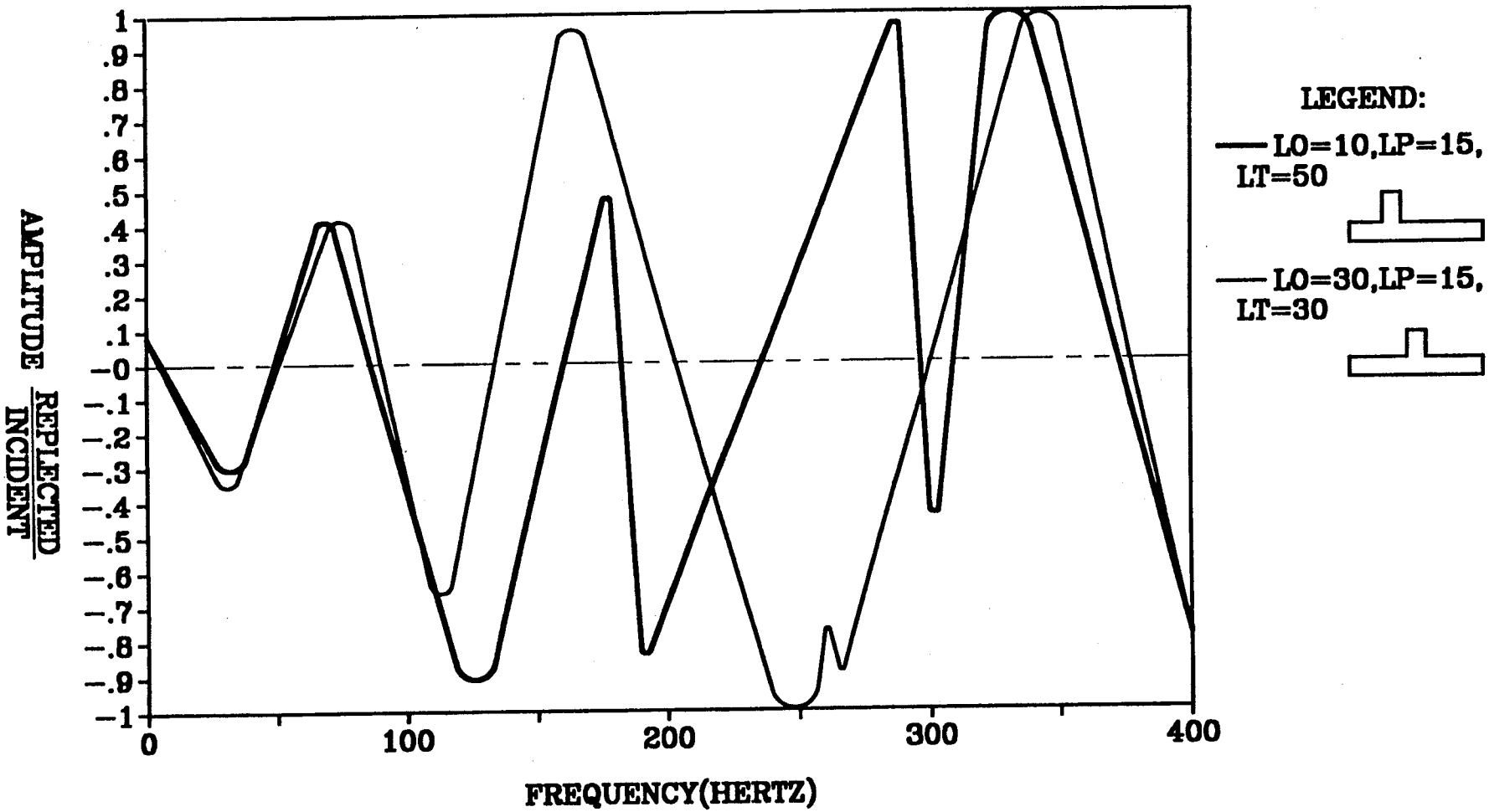

FIGS. 3 through 5 are plots showing the predicted ratio of the reflected wave amplitude to the incident wave amplitude. Maximum pressure pulse cancellation occurs when this value is $-1$. The locations of LO, LP and LT are shown in FIG. 2.

The predicted results for two different stub pipe lengths is shown in FIG. 3. Also shown in FIG. 3 is the predicted result for typical discharge piping without a stub pipe. Increasing the stub pipe length results in a larger shift of the frequency to the left. The predicted results for moving the location of the stub pipe are shown in FIGS. 4 and 5. Moving the stub pipe closer to the compressor shifts the second peak of resonance to a higher frequency, and shifts the second peak of cancellation to a lower frequency, both at lower amplitude. This results in resonance and cancellation being closer together, but at reduced amplitude.

The preferred stub pipe location is towards the middle of the discharge pipe so that the difference between resonance and cancellation is not too close.

Entrained oil in the screw compressor discharge affects the "length" of the stub pipe. This effect is not easily calculated. The best length is probably most easily determined by trial and error.

Having described the invention, what is claimed is:

1. In combination:

a screw compressor;

a tank;

a conduit connecting the discharge of the screw compressor to the inlet of the tank; and a compensation means for reducing the pulse amplitude of pressure pulses in the conduit, the compensation means comprising a chamber attached to the conduit;

the discharge of the screw compressor containing primary pressure pulsations, the primary pressure pulsations being reflected back to the discharge of the screw compressor as reflected pressure pulsations, the primary pressure pulsations also being reflected back from the chamber to the discharge of the screw compressor as compensating pressure pulsations, the compensating pressure pulsations combining with the reflected pressure pulsations so that the combined pressure pulsations arrive at the discharge of the screw compressor out of phase with the primary pressure pulsations thereby reducing the pulse amplitude of the pressure pulses.

2. The combination according to claim 1, wherein the chamber is located midway between the discharge of the screw compressor and the inlet of the tank.

3. A method of reducing pressure pulsations in a compressed air system having an air compressor, a tank and a discharge pipe, the discharge of the air compressor containing primary pressure pulsations, comprising the step of:

producing compensating pressure pulsations with a reflecting chamber, the compensating pressure pulsations combining with reflected primary pressure pulsations so that the combined pressure pulsations arrive at the discharge of the compressor out of phase with the primary pressure pulsations thereby reducing the pulse amplitude of the pressure pulsations.

* * * * *